US012612242B2

(12) United States Patent
Campeau

(10) Patent No.: US 12,612,242 B2
(45) Date of Patent: Apr. 28, 2026

(54) TELESCOPIC SHIPPING CONTAINER

(71) Applicant: Daniel Campeau, Benalmádena (ES)

(72) Inventor: Daniel Campeau, Benalmádena (ES)

( * ) Notice: Subject to any disclaimer, the term of this patent is extended or adjusted under 35 U.S.C. 154(b) by 0 days.

(21) Appl. No.: 18/700,562

(22) PCT Filed: Nov. 21, 2022

(86) PCT No.: PCT/EP2022/082549
§ 371 (c)(1),
(2) Date: Apr. 11, 2024

(87) PCT Pub. No.: WO2023/094299
PCT Pub. Date: Jun. 1, 2023

(65) Prior Publication Data

US 2024/0391687 A1 Nov. 28, 2024

(30) Foreign Application Priority Data

Nov. 24, 2021 (EP) ..... 21210103

(51) Int. Cl.
*B65D 88/00* (2006.01)
*B65D 88/12* (2006.01)
(Continued)

(52) U.S. Cl.
CPC ..... *B65D 88/005* (2013.01); *B65D 88/121* (2013.01); *B65D 90/0026* (2013.01); *B65D 90/008* (2013.01); *E04B 1/34312* (2023.08)

(58) Field of Classification Search
CPC ..... B65D 88/121; B65D 88/12; B65D 88/52; B65D 88/522; B65D 88/524;
(Continued)

(56) References Cited

U.S. PATENT DOCUMENTS 2,868,407 A * 1/1959 Woodcock ..... B65D 88/524 220/7
2,944,852 A 7/1960 Snyder
(Continued)

FOREIGN PATENT DOCUMENTS

AU 2006200382 A1 8/2006
CN 1168129 A 12/1997
(Continued)

OTHER PUBLICATIONS

Rodrigues et al., "Chemicals from ethanol—The acetone one-pot synthesis", Applied Catalysis A: General, 2013, pp. 111-118, vol. 458.

*Primary Examiner* — Steven A. Reynolds
*Assistant Examiner* — Prince Pal
(74) *Attorney, Agent, or Firm* — The Webb Law Firm

(57) ABSTRACT

The invention relates to a telescopic shipping container transformable between a reduced configuration having reduced height and an erected configuration, the container including a top segment and a bottom segment. The container bottom segment includes a rigid base panel having four corner fittings and the container top segment includes a rigid roof panel having four corner fittings. The container includes four corner posts each extending between a roof corner fitting and a base corner fitting and including a top element rigidly connected to the roof panel and a bottom element rigidly connected to the base panel, each corner post having a retractable/extendable configuration. The container is characterized in that the container includes a front-end panel having at least one hinged door leaf. The door leaf includes a top section pivotably connected to the top element of the adjacent corner post, a bottom section pivotably connected to the bottom element of the adjacent corner post, and an intermediate section that is in telescopic engagement with the top section of the door leaf and with the bottom
(Continued)

section of the door leaf. The intermediate section interconnects the top section and the bottom section.

12 Claims, 5 Drawing Sheets

(51) Int. Cl.
*B65D 90/00* (2006.01)
*E04B 1/343* (2006.01)

(58) Field of Classification Search
CPC ..... B65D 90/008; E04H 2001/1283; E04H 1/1205; E04H 15/46; E04B 1/34312
USPC ..... 220/1.5, 6, 7, 4.28, 666; 206/216
See application file for complete search history.

(56) References Cited

U.S. PATENT DOCUMENTS 3,612,330 A * 10/1971 Baer ..... B65D 88/524 74/89.22
3,658,035 A * 4/1972 Harris ..... A01K 63/003 220/665
3,796,342 A * 3/1974 Sanders ..... B65D 11/1826 220/6
4,099,640 A * 7/1978 Nessfield ..... B65D 88/522 220/6
5,069,352 A * 12/1991 Harbolt ..... B65D 88/121 220/723
5,265,748 A * 11/1993 Furukawa ..... B65D 88/121 220/1.5
5,511,908 A * 4/1996 Van Valkenburgh ..... B65F 1/1426 296/181.6
5,678,715 A * 10/1997 Sjostedt ..... B65D 90/022 220/1.5
5,865,334 A * 2/1999 Ruiz ..... B65D 85/48 206/451
7,296,704 B2 * 11/2007 Ferrini ..... B65D 88/78 220/6
7,882,973 B2 * 2/2011 Krohn ..... B65D 88/12 220/666
7,931,164 B2 * 4/2011 Krohn ..... B65D 88/12 220/666
8,196,766 B2 * 6/2012 Schrayvogel ..... B65D 90/021 206/508
8,650,806 B1 * 2/2014 Condie ..... E04H 1/1277 52/79.5
8,770,421 B2 * 7/2014 Hay ..... B65F 1/02 220/4.28
9,003,716 B1 * 4/2015 Gill ..... E04B 1/348 52/211
9,016,001 B2 * 4/2015 Heger ..... E04B 1/3442 52/79.5
9,221,599 B2 * 12/2015 Brennan, Jr. ..... B65D 90/08
9,440,786 B2 * 9/2016 Giesbers ..... B65D 88/524
9,624,712 B2 * 4/2017 Bottin ..... E04B 2/56
9,688,466 B2 * 6/2017 Ronstadt ..... B65D 90/021
9,751,688 B2 * 9/2017 Churbuck ..... B65D 88/522
9,802,754 B2 * 10/2017 Navalon Simon ... B65D 88/522
10,219,447 B1 * 3/2019 DeCarli ..... E04B 1/3442
10,315,839 B2 * 6/2019 Kondoh ..... B65D 88/528
10,364,095 B2 * 7/2019 Utz ..... B65D 88/522
10,851,552 B1 * 12/2020 DeMatteis ..... E04H 1/1205
10,882,689 B2 * 1/2021 Kendall ..... B65D 88/52
11,046,507 B2 * 6/2021 Kendall ..... B65D 88/121
11,109,519 B2 * 8/2021 Deighton ..... E04B 1/34321
11,136,183 B2 * 10/2021 Ota ..... B65D 21/066
11,235,921 B2 * 2/2022 Press ..... B65D 88/522
11,274,870 B2 * 3/2022 Provest ..... F25D 13/00
11,498,753 B2 * 11/2022 Kyte ..... B65D 88/52
D1,016,327 S * 2/2024 Boucard ..... D25/33
12,382,944 B2 * 8/2025 Davis ..... B65D 90/008
2003/0183544 A1 * 10/2003 Lawrence ..... B65D 19/16 206/335
2004/0169038 A1 * 9/2004 Pickler ..... B60P 1/50 220/1.5
2004/0188433 A1 * 9/2004 Morales ..... B65D 90/0033 220/1.5
2004/0262305 A1 * 12/2004 Myers ..... B65D 90/0026 220/1.5
2006/0016807 A1 * 1/2006 Hsu ..... B65D 88/524 220/1.5
2007/0271857 A1 * 11/2007 Heather ..... B65D 88/022 52/79.9
2008/0116199 A1 * 5/2008 Bublitz ..... B65D 88/14 493/137
2008/0266165 A1 * 10/2008 Daly ..... G01S 7/02 340/5.82
2008/0277390 A1 * 11/2008 Nagura ..... B65D 88/542 220/6
2009/0217600 A1 * 9/2009 De Azambuja .... B65D 90/0006 52/79.5
2010/0018967 A1 * 1/2010 Schrayvogel ..... B65D 90/0086 220/6
2010/0102056 A1 * 4/2010 Bellehumeur ..... B65D 90/022 220/666
2010/0264137 A1 * 10/2010 Lampe ..... B29C 41/06 220/651
2011/0023925 A1 * 2/2011 Johnson ..... E04H 15/46 29/897.3
2012/0048846 A1 * 3/2012 Choi ..... F16F 9/516 220/1.5
2012/0061387 A1 * 3/2012 Nam ..... B65D 90/008 220/812
2012/0061390 A1 * 3/2012 Giesbers ..... B65D 88/524 220/1.5
2012/0181268 A1 * 7/2012 Skarbovig ..... B65D 88/745 220/1.5
2013/0147634 A1 * 6/2013 Abraham, III ..... E04H 5/02 348/162
2013/0180981 A1 * 7/2013 Meijers ..... B65D 88/522 493/162
2014/0144907 A1 * 5/2014 Giesbers ..... B65D 88/12 220/1.5
2014/0166647 A1 * 6/2014 Sheesley ..... B65D 88/30 220/1.5
2014/0231422 A1 * 8/2014 Kochanowski ..... E05D 11/1007 220/1.5
2014/0246425 A1 * 9/2014 Janin ..... B65D 88/005 220/1.5
2014/0263306 A1 * 9/2014 Brennan, Jr. ..... B65D 90/0026 16/221
2015/0298855 A1 * 10/2015 Kochanowski .... B65D 21/0215 220/6
2016/0083176 A1 * 3/2016 Kraft ..... B65D 88/522 220/1.5
2016/0090234 A1 * 3/2016 Ronstadt ..... B62D 33/08 220/6
2016/0137404 A1 * 5/2016 Steiner ..... B61D 9/14 220/1.5
2016/0251153 A1 * 9/2016 Navalon ..... B65D 88/522 220/1.5
2017/0021998 A1 * 1/2017 Flint ..... B65D 90/08
2017/0210556 A1 * 7/2017 Kraft ..... B65D 88/121
2017/0247184 A1 * 8/2017 Heskamp ..... B65D 88/121
2017/0307433 A1 * 10/2017 Espinosa ..... B65D 90/008
2018/0009602 A1 * 1/2018 Park ..... B65D 88/524
2018/0274258 A1 * 9/2018 Newman ..... E04B 1/34352
2019/0263587 A1 * 8/2019 Ota ..... B65D 88/52
2019/0334730 A1 10/2019 Endress et al.
2019/0345730 A1 11/2019 Tafuro et al.
2021/0246675 A1 * 8/2021 Pearce ..... E04B 1/3448
2022/0073270 A1 * 3/2022 Taylor ..... B65D 90/0026
2022/0090399 A1 * 3/2022 Nelson ..... F24S 25/00
2024/0391687 A1 * 11/2024 Campeau ..... B65D 88/121

(56) References Cited

U.S. PATENT DOCUMENTS

FOREIGN PATENT DOCUMENTS

| | | | |
|---|---|---|---|
| CN | 1304862 | A | 7/2001 |
| CN | 101186248 | A | 5/2008 |
| EP | 3466841 | A1 | 4/2019 |
| KR | 101194964 | B1 | 10/2012 |
| WO | 2005037752 | A1 | 4/2005 |
| WO | 2010022347 | A2 | 2/2010 |
| WO | 2010022347 | A3 | 2/2010 |
| WO | 2014154799 | A1 | 10/2014 |
| WO | 2018071905 | A1 | 4/2018 |
| WO | 2020059697 | A1 | 3/2020 |
| WO | 2021087020 | A1 | 5/2021 |

* cited by examiner

TELESCOPIC SHIPPING CONTAINER

CROSS REFERENCE TO RELATED APPLICATIONS

This application is the United States national phase of International Patent Application No. PCT/EP2022/082549 filed Nov. 21, 2022, and claims priority to European Patent Application No. 21210103.4 filed Nov. 24, 2021, the disclosures of which are hereby incorporated by reference in their entireties.

BACKGROUND OF THE INVENTION

Field of the Invention

The present invention relates generally to the field of shipping containers, also known as sea containers, freight containers, cargo containers, etc. Such containers are designed to meet standardized transporting, lifting and stacking requirements, i.e. they are designed to be conveniently moved from one mode of transport to another and thereby eliminating the need to unload the cargo from the first mode of transport and load the cargo to another mode of transport. Virtually the entire global shipping container market has adapted the standard of the International Organization for Standardization (ISO).

Further, the present invention relates specifically to the field of shipping containers that are transformable between a reduced configuration and an erected configuration, i.e. known as telescopic, foldable or collapsible shipping container, such that each container occupy less volumetric footprint and more containers may be transported together when the container is in the reduced configuration. The container comprises a top segment and a bottom segment, wherein the container bottom segment comprises a rigid base panel having four corner fittings and the container top segment comprises a rigid roof panel having four corner fittings. The container comprises four corner posts each extending between a roof corner fitting and a base corner fitting and comprising a top element rigidly connected to the roof panel and a bottom element rigidly connected to the base panel, each corner post having a retractable/extendable configuration.

Description of Related Art

It is also known to use collapsible shipping containers as shelters, temporary housing or other temporary buildings, for instance at places suffering from weather disasters in order to provide temporary shelter/houses for the suffering people, at music festivals to provide a better alternative to tents, at sport events to provide headquarter for the sport event management, at temporary military base camps to provide headquarter and troop-rooms, etc. These containers may be reused many times at different locations.

One example is disclosed in US 2014/0263306, wherein the container has a collapsed configuration for transport and an erected configuration when in use. This container is designed such that each side panel has a top element hinged to the roof panel and has a bottom element hinged to the base panel and the top element and the bottom element are also hinged to each other, thereby the side panels will become double folded into the interior of the container when the container is in the collapsed configuration. Thereto the front-end panel and the back-end panel, together with the corner posts belonging to them, are hinged to the base panel and are also folded into the interior of the container when the container is in the collapsed configuration. Thus, when the container is in the collapsed configuration, the roof panel is lowered and secured to the base panel and virtually the entire interior of the collapsed container is filled with the end panels and side panels. Thus, the collapsible container may not carry any other cargo, furniture, fixtures, etc. when in the collapsed configuration. Thereby, any furniture, fixtures, etc. need to be separately transported in parallel to the collapsible container. WO 2010/022347 discloses another example of a telescopic container, wherein the top elements of the side panels are rigidly connected to the top panel and the bottom elements are rigidly connected to the base panel. The disclosed configuration will have difficulties to comply with the standard of the International Organization for Standardization (ISO) both when erected and collapsed.

Thus, there is a need to provide a shipping container that fulfil all regulations/standards in the erected configuration and in the reduced configuration, and that is transformable between a reduced configuration and an erected configuration, and that is able to carry all the necessary cargo, equipment, furniture, fixtures, etc. needed when the container is used in the erected configuration also when used/transported in the reduced configuration.

OBJECT OF THE INVENTION

The present invention aims at obviating the aforementioned disadvantages and failings of previously known containers that are transformable between a reduced configuration and an erected configuration, and at providing an improved container. A primary object of the present invention is to provide an improved container of the initially defined type that may carry all the necessary cargo, equipment, furniture, fixtures, etc. needed when the container is used in the erected configuration also when transported in the reduced configuration. It is another object of the present invention to provide a container, which is weatherproof both in the reduced configuration and in the erected configuration.

It is yet another object of the present invention to provide a container which may be lifted and stacked both in the reduced configuration and in the erected configuration. It is also an object of the present invention to provide a container that can be transformed between the erected configuration and the reduced configuration multiple times.

It is another object of the present invention to provide a container which is transformed between the reduced configuration and the erected configuration, and vice versa, using the crane that is used for lifting the container from the truck, the railway-wagon, etc. It is yet another object of the present invention to provide a container wherein a maximum mutual displacement between the top segment and the bottom segment is guaranteed.

SUMMARY OF THE INVENTION

According to the invention at least the primary object is attained by means of the initially defined telescopic shipping container having the features described herein. Preferred embodiments of the present invention are further described herein.

According to the present invention, there is provided a telescopic container of the initially defined type, which is characterized in that the container comprises a front-end panel having at least one hinged door leaf, wherein the door leaf comprises a top section pivotably connected to the top element of the adjacent corner post, a bottom section pivotably connected to the bottom element of the adjacent corner post, and an intermediate section that is in telescopic engagement with the top section of the door leaf and with the bottom section of the door leaf, wherein the intermediate section interconnects the top section and the bottom section.

Thus, the present invention is based on the insight that the telescopic container is made up of two main components/segments, i.e. a male container half comprising the base panel and a female container half comprising the roof panel, wherein when the container is in the reduced configuration the female container half is lowered over the male container half leaving enough floor area and interior volume to carry all the necessary cargo, equipment, furniture, fixtures, etc. needed when the container is used in the erected configuration also when transported in the reduced configuration. Thereto, the present invention is based on the insight that the container is subject to extreme and tough handling and thereby requires a reliable design/structure adapted to stand such handling without jeopardizing the transformability over time, at the same time as the container may be opened and closed at any time, i.e. when the container is in the reduced configuration, in the erected configuration and therebetween. Thus, part of the top section and part of the bottom section of the door leaf does not overlap each other when the container is in the reduced configuration, and the entire door leaf is pivoted (opened/closed) as a single element both in the erected configuration and in the reduced/collapsed configuration.

According to various embodiments of the present invention, the container comprises at least four hinged girder assemblies, wherein each girder assembly comprises an upper end pivotably connected to the container top segment and a lower end pivotably connected to the container bottom segment, the girder assemblies being in upright position and supporting the container top segment when the container is in the erected configuration.

According to various embodiments of the present invention, the girder assemblies are secured in the upright position when the container is in the erected configuration, in order to prevent mutual displacement between the container top segment and the container bottom segment when the container is in the erected configuration. Thereby, when the girder assemblies are in the upright position and carries the entire load of the container top segment, the girder assemblies as such are prevented from departing from their upright position.

According to various embodiments of the present invention, the girder assemblies are secured in a folded position when the container is in the reduced configuration, in order to prevent mutual displacement between the container top segment and the container bottom segment when the container is in the reduced configuration. Thereby, when the girder assemblies are in the folded position, the girder assemblies as such are prevented from departing from their folded position and the container may be lifted in the container top segment and still remain in the reduced configuration.

Further advantages with and features of the invention will be apparent from the following detailed description of preferred embodiments.

BRIEF DESCRIPTION OF THE DRAWINGS

The terms Fig., Figs., Figure, and Figures are used interchangeably in the specification to refer to the corresponding figures in the drawings.

A more complete understanding of the abovementioned and other features and advantages of the present invention will be apparent from the following detailed description of preferred embodiments in conjunction with the appended drawings, wherein.

DESCRIPTION OF THE INVENTION

The present invention relates to a telescopic shipping container, generally designated 1, that is transformable between an erected configuration and a reduced configuration, i.e. a configuration having reduced height. The reduced configuration is preferred when the container 1 is handled, transported, stored, stacked, etc. and the erected configuration is preferably only used when the container 1 is in use. The container 1 shall be construed to be capable of being handled without any permanent deformation when lifted in conventional manner, and shall comply with the requirements of the CSC (Convention for Safe Containers) and applicable ISO standards.

The interior of the container 1 may be pre-equipped with electric wiring including lamps, power sockets, etc. and the container 1 may externally comprise a male contact for connecting the internal electric wiring to the power mains, to an electric generator, to solar cells located on top of the container 1, etc., i.e. the container 1 may be prepared for being plugged-in. Thereto the interior of the container 1 may be pre-equipped with furniture, such as beds, tables, chairs, storage cabinets, water closet and sink to be connected to drain and water mains, etc. It is important that the furniture shall not obstruct the container 1 to reach the reduced configuration.

Figure 1:
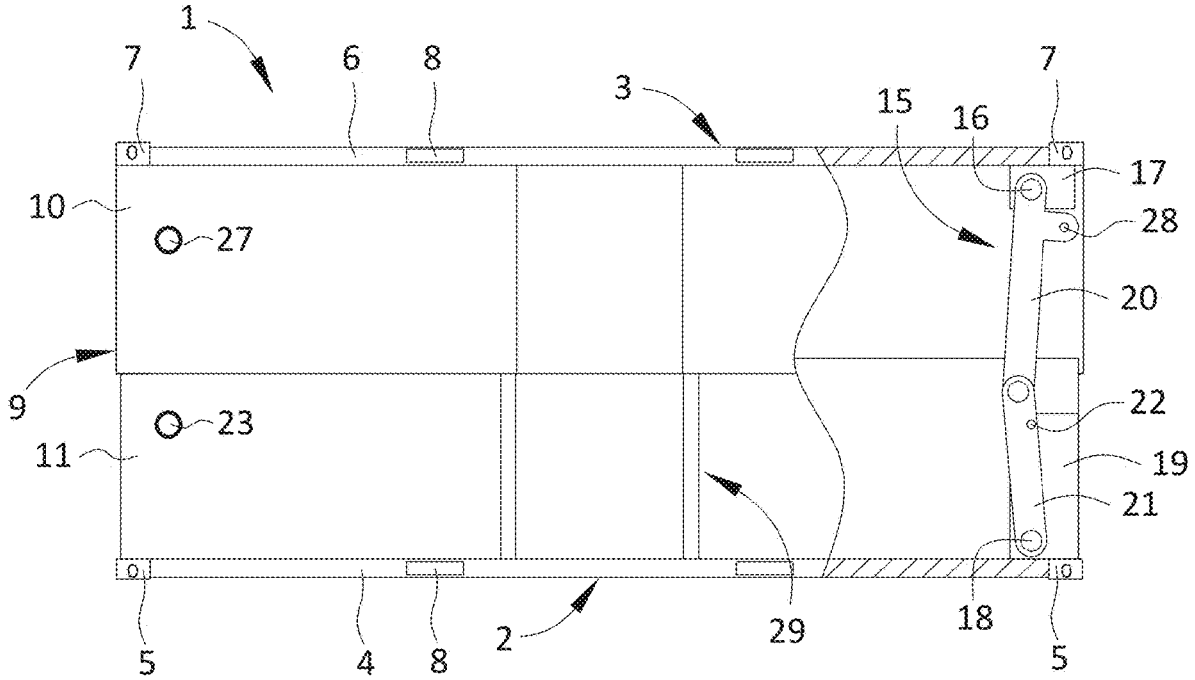
FIG. 1 is a schematic illustration disclosing a side view of the inventive telescopic shipping container in the erected configuration, partly in cross section disclosing a hinged girder assembly in upright position.
Figure 2:
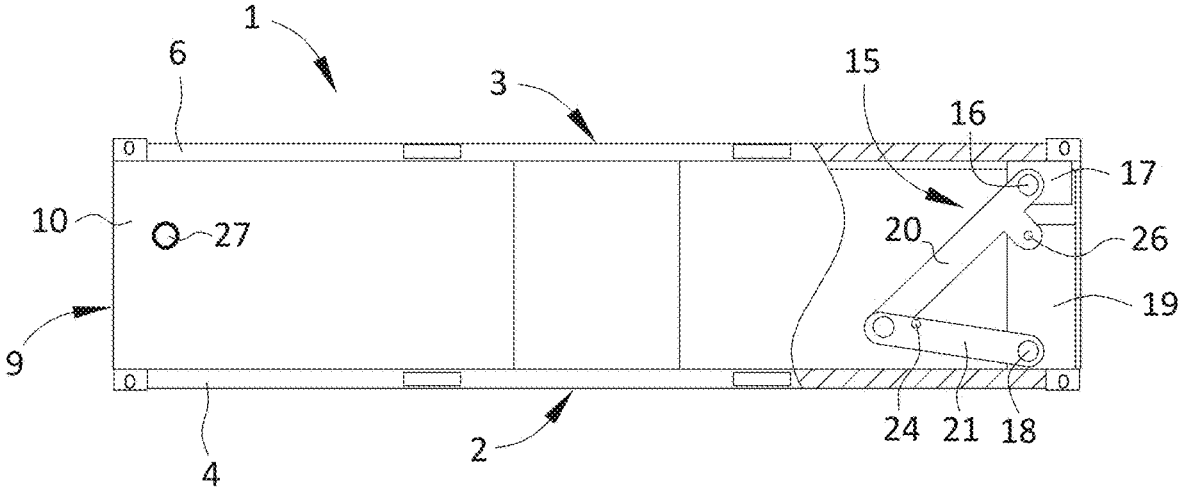
FIG. 2 is a schematic illustration disclosing a side view of the inventive telescopic shipping container in the reduced configuration, partly in cross section disclosing the hinged girder assembly in folded position.
Figure 3:
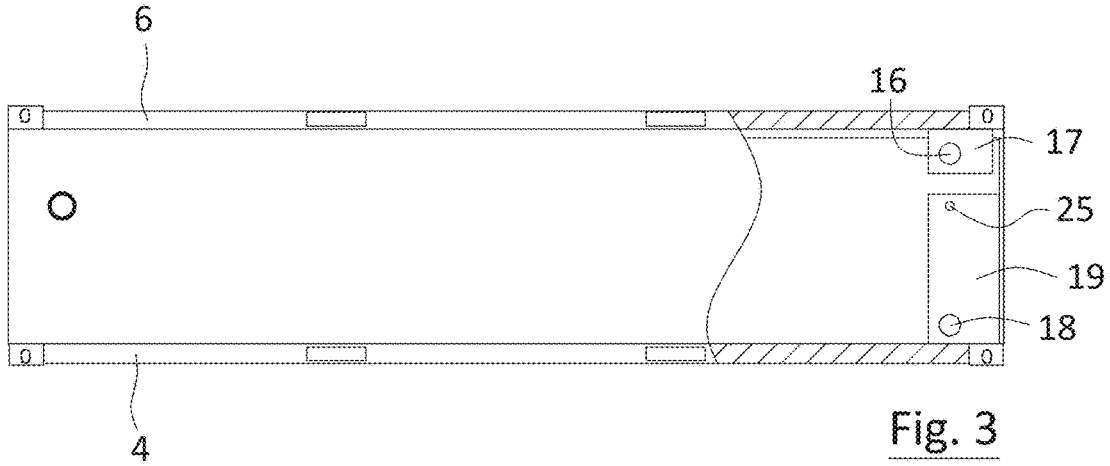
FIG. 3 is a schematic illustration disclosing the side view of the inventive telescopic shipping container according to FIG. 2, wherein the hinged girder assembly is removed.

The container 1 comprises two major components, reference is initially made to FIGS. 1-3 disclosing an illustrative embodiment of the inventive container 1 in the erected configuration and reduced/collapsed configuration. The two components are constituted by a bottom/male container half 2, i.e. bottom segment, and a top/female container half 3, i.e. top segment.

The container bottom segment 2 comprises a rigid base panel 4 having four base corner fittings 5, and the container top segment 3 comprises a rigid roof panel 6 having four roof corner fittings 7. The container 1 comprises four corners, wherein each corner extends between a roof corner fitting 7 and a base corner fitting 5. The container 1 lacks weight carrying corner posts, but the corner posts 56 are configured to provide structural stability/strength to each of the top segment 3 and bottom segment 2 and to provide guiding during transformation between the erected configuration and the reduced configuration.

Preferably, the roof panel 6 and/or the base panel 4 comprise insulation, and at least the outer layer of the base panel 4 and the roof panel 6 is preferably made of metal. The inner layer of the base panel 4 may be constituted by a wooden/plastic/metal floor. The base panel 4 and/or the roof panel 6 may be equipped with forklift fittings 8 configured for being lifted by means of a forklift, preferably in conformance with ISO standards. The forklift fittings 8 comprise suitable drain/rinse holes.

The base corner fittings 5 and the roof corner fittings 7 are preferably standardized corner fittings designed in conformance with ISO 1161. Thereby the container 1 may be lifted at the roof corner fittings 7 by means of spreaders fitted with hooks, shackles, twistlocks, etc. and be lifted at the base corner fittings 5 using slings with terminal fittings, hooks or equivalent. The container 1 may also be transported and secured by means of twistlocks or equivalent at the base corner fittings 5 and/or the roof corner fittings 7. The eight corner fittings, i.e. the four base corner fittings 5 and the four roof corner fittings 7, together define the outer boundaries of the volumetric footprint of the container 1. Thus, when placing multiple containers 1 side by side and/or one on top of the other, the corner fittings of adjacent containers 1 will contact each other. The corner fittings are made of metal. The container 1 may also comprise additional lifting shackles or the like, adjacent the roof corner fittings 7.

The container 1 comprises wall panels extending between the roof panel 6 and the base panel 4. Preferably, the wall panels comprise insulation, and at least the outer layer of the wall panels is preferably made of metal.

According to various embodiments, the container 1 comprises two opposite side panels 9, wherein each side panel 9 comprises a top section 10 rigidly connected to the roof panel 6 and constitutes part of the container top segment 3 and comprises a bottom section 11 rigidly connected to the base panel 4 and constitutes part of the container bottom segment 2. According to various embodiments, the top section 10 and the bottom section 11 of each side panel 9 are in telescopic engagement with each other. The top section 10 is preferably located outside the bottom section 11. i.e. the bottom section 11 is more or less entirely covered by the top section 10 when the container 1 is in the reduced configuration.

According to various embodiments, the container 1 has an overall elongated shape, wherein the side panels 9 are longer than the width of the container 1. However, the side panels 9 may have equal length as the width of the container 1, or the width of the container 1 may be wider than the length of the side panels 9. The width and length of the container 1 is preferably in conformance with standard shipping containers, i.e. ISO standard, such as 20-feet, 40-feet, etc.

In addition to the side panels 9, the container 1 also comprises a front-end panel 12 (see FIG. 6) and a back-end panel 13 (see FIG. 7) located opposite the front-end panel 12. The front-end panel 12 and the back-end panel 13 extend between the opposite side panels 9, i.e. the wall panels of the container 1 meet at the corners/corner posts of the container 1. Part of the side panel 9 and/or the adjoining end panel comprise a corner post 56 at the corner of the container 1.

Each corner post 56 comprises a top element 57 and a bottom element 58, wherein the top element 57 is rigidly connected to the roof panel 6 and the bottom element 58 is rigidly connected to the base panel 4. Each corner post 56 has a retractable/extendable configuration, retracted state when the container 1 is in the reduced configuration and extended state when the container 1 is in the erected configuration. The top element 57 and the bottom element 58 of the corner post 56 are arranged in telescopic engagement with each other, i.e. the top element 57 and the bottom element 58 are displaceable in the axial extension in relation to each other between the retracted state and the extended state. According to various embodiments, the corner posts 56 or the corners of the container 1 comprise rollers, low-friction plates or equivalent corner guide assemblies 14 located at the interface between the top segment 3 and the bottom segment 2, in order to prevent jamming/wedging during hoisting and lowering, especially when the ground is not perfectly horizontal.

According to various embodiments, the container 1 comprises at least four hinged girder assemblies 15, wherein each girder assembly 15 comprises an upper end pivotably connected to the container top segment 3 and a lower end pivotably connected to the container bottom segment 2. Thus, the upper end of the girder assembly 15 is journaled/pivoted about a pin/pivot 16, wherein the pin/pivot 16 is connected to the container top segment 3. Preferably, the pin/pivot 16 is connected to an ear/plate 17, or the like, that is connected to the roof panel 6. Thus, the lower end of the girder assembly 15 is journaled/pivoted about a pin/pivot 18, wherein the pin/pivot 18 is connected to the container bottom segment 2. Preferably, the pin/pivot 18 is connected to an ear/plate 19, or the like, that is connected to the base panel 4 and/or to the bottom element 58 of the corner post 56.

The hinged girder assemblies 15 prevent unwanted disconnection of the container top segment 3 from the container bottom segment 2, when the top segment 3 is lifted from the bottom segment 2 in order to transfer the container 1 from the reduced configuration to the erected configuration. The bottom segment 2 is kept on the ground by its own weight when the top segment 3 is lifted from the reduced configuration. When the girder assemblies 15 has reach the maximum displacement, the container bottom segment 2 will be lifted together with the container top segment 3 via the girder assemblies 15.

The four hinged girder 15 assemblies are distributed/allocated such that the girder assemblies 15 is associated with one corner of the container 1 each, i.e. the individual girder assembly 15 is located near the associated corner of the container 1.

The girder assembly 15 is displaceable between an upright position when the container 1 is in the erected configuration and a folded position when the container 1 is in the reduces configuration. According to various embodiments, the pin/pivot 16 at the upper end of the girder assembly is located vertically above the pin/pivot 18 at the lower end of the girder assembly. When the container 1 is in the erected configuration and the girder assemblies 15 are in the upright position, the girder assemblies 15 support the container top segment 3, i.e. the weight of the container top segment 3 and any extra weight added on top of the container 1. Thereto, the girder assemblies 15 carry the weight of the bottom segment 2, together with the cargo, when the container 1 in the erected configuration is lifted from the ground. The girder assembly 15 is preferably prevented from moving/displacing in the transverse direction of the container 1, i.e. along the extension of the pivots 16,18, when the container 1 is in the erected configuration, for instance by the plate 19.

According to the disclosed embodiment, each girder assembly 15 comprises an upper arm 20 and a lower arm 21 pivotably connected to each other. It shall be pointed out that the upper arm 20 and/or lower arm 21 may be constituted by one element each or by parallel elements or a combination thereof.

According to various embodiments, each side panel 9 comprises at least two hinged girder assemblies 15, i.e. one at each end of the side panel 9 associated with the corners of the container 1. One or more extra girder assemblies may be located intermediate the corners of the container 1, especially when the container 1 is long (for instance a 40-feet container).

According to various embodiments, the bottom section 11 of the side panel 9 of the container bottom segment 2 is a double wall construction (see FIG. 5), wherein the hinged girder assembly 15 is located between the inner and outer wall of said double wall construction in order to protect the girder assembly 15 as such and to secure its operation and also in order to protect operators and cargo located inside the container 1 during transformation of the container 1.

According to various embodiments, the top section 10 of the side panel 9 of the container top segment 3 is a double wall construction, wherein the hinged girder assembly 15 is located between the inner and outer wall of said double wall construction in order to protect the girder assembly 15 as such and to secure its operation and also in order to protect operators and cargo located inside the container 1 during transformation of the container 1. According to other embodiments, the top section 10 of the side panel 9 of the container top segment 3 only comprises an outer wall (see FIG. 4).

According to various embodiments, the girder assemblies 15 are secured in the upright position when the container 1 is in the erected configuration, in order to prevent mutual displacement between the container top segment 3 and the container bottom segment 2 when the container 1 is in the erected configuration, i.e. preventing the top segment 3 from going down.

Thus, the container 1 comprises a securing element 22, e.g. a pin, ratchet, etc., that is in engagement with the girder assembly 15 and the container bottom segment 2 in order to prevent displacement of the girder assembly 15 from the upright position. The securing element 22 is preferably in engagement with the girder assembly 15 and the ear/plate 19 that is connected to the base panel 4 and/or to the bottom element 58 of the corner post 56. The securing element 22 is according to various embodiments maneuverable/accessible from the outside of the container 1 through an opening 23 in the bottom section 11 of the side panel 9 of the container bottom segment 2. The opening 23 is preferably covered by a lid or the like. According to the disclosed embodiment a securing element 22 in the shape of a pin is in engagement with a hole 24 in the girder assembly 15 and with a hole 25 in the ear/plate 19. When the container 1 is transformed into the erected configuration, i.e. when the top segment 3 is lifted max in relation to the bottom segment 2 and the girder assembly 15 is in the upright position, the securing element 22 is easily engaged/disengaged. It shall be pointed out that it is the girder assemblies 15 as such when located in the upright position that support the weight of the container top segment 3 and any additional weight. It shall be noted that the ear/plate 19 may divided into two separate members, i.e. a lower member for pivotably connection of the lower end of the girder assembly 15 and an upper member for engagement with the securing element 22.

According to various embodiments, the angel between the upper arm 20 and the lower arm 21 of the girder assembly 15 is less than 180 degrees when the girder assembly is in the upright position and equal to or more than 160 degrees, preferably equal to or more than 170 degrees. Thereby, when not locked in the upright position, the girder assembly 15 will automatically fold when the container top segment 3 is lowered. According to various embodiments the girder assembly 15 is biased by a spring element from the upright position, such that the girder assembly 15 will automatically fold when the container top segment 3 is lowered. Different combinations are also conceivable.

According to various embodiments, the girder assemblies 15 are secured in the folded position when the container 1 is in the reduced configuration, in order to prevent mutual displacement between the container top segment 3 and the container bottom segment 2 when the container 1 is in the reduced configuration, i.e. preventing the top segment 3 from going up.

Thus, the container 1 comprises a securing element 26, e.g. a pin, ratchet, etc., that is in engagement with the girder assembly 15 and the container bottom segment 2 in order to prevent displacement of the girder assembly 15 from the folded position. The securing element 26 is preferably in engagement with the girder assembly 15 and the ear/plate 19 that is connected to the base panel 4 and/or to the bottom element 58 of the corner post 56. The securing element 26 is according to various embodiments maneuverable/accessible from the outside of the container 1 through an opening 27 in the top section 10 of the side panel 9 of the container top segment 3. The opening 27 is preferably covered by a lid or the like. Preferably the opening 27 in the top section 10 is aligned with the opening 23 in the bottom section 11 when the container 1 is in the reduced configuration.

According to the disclosed embodiment a securing element 26 in the shape of a pin is in engagement with a hole 28 in the girder assembly 15 and with the hole 25 in the ear/plate 19. When the container 1 is transformed into the reduced configuration, i.e. when the top segment 3 is lowered max in relation to the bottom segment 2 and the girder assembly 15 is in the folded position, the securing element 26 is easily engaged/disengaged. When the securing element 26 is in engagement, the container bottom segment 2 will follow the container top segment 3 when the top segment 3 is lifted, e.g. in the roof corner fittings 7, i.e. the container 1 will remain in the reduced configuration.

It shall be pointed out that if the securing element 26 is not present, the container 1 may be lifted in the reduced configuration by lifting in the container bottom segment 2, e.g. in the base corner fittings 5 or the forklift fittings 8 in the container bottom segment 2.

Figure 4:
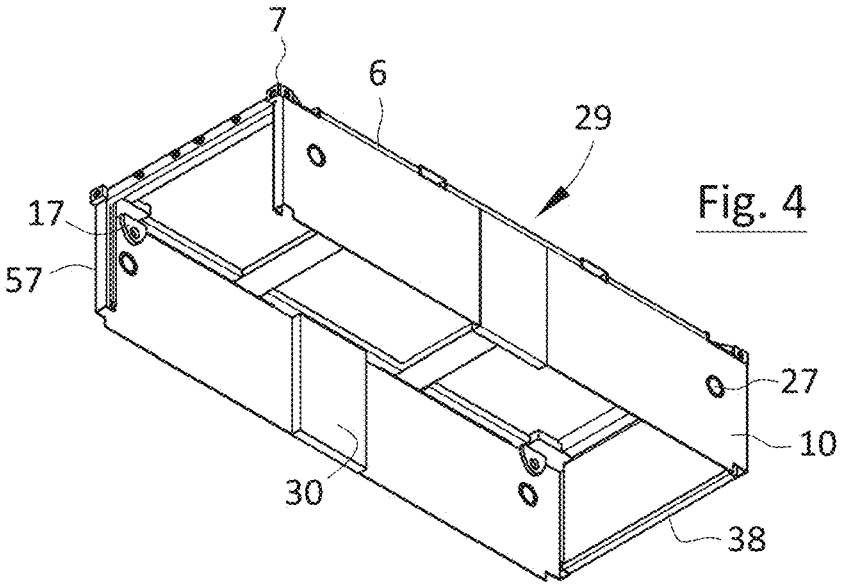
FIG. 4 is a schematic illustration disclosing the container top segment in perspective view from below having the front-end to the left and the back-end to the right.
Figure 5:
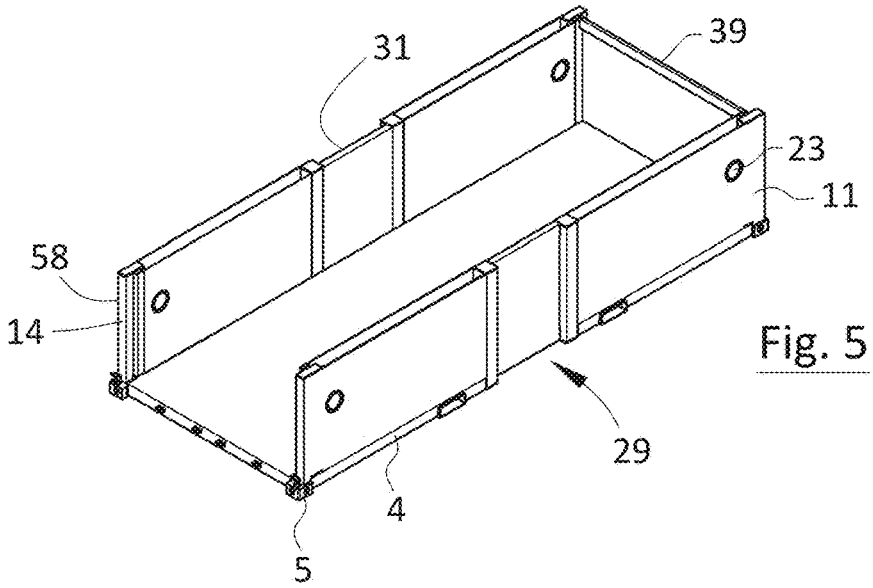
FIG. 5 is a schematic illustration disclosing the container bottom segment in perspective view from above having the front-end to the left and the back-end to the right.

Reference is now made to FIGS. 4 and 5, disclosing schematic perspective views of the container top segment 3 and the container bottom segment 2, respectively. FIG. 4 is seen from below and FIG. 5 is seen from above.

According to various embodiments each side panel 9 comprises a center guide assembly, generally designated 29, extending between the roof panel 6 and the base panel 4 at the center region of the container 1, in order to prevent jamming/wedging during hoisting and lowering. The center guide assembly 29, according to the disclosed embodiment, comprises a male element 30 of the top segment 3 cooperating with a female element 31 of the bottom segment 2, i.e. the male element 30 and the female element 31 admit mutual displacement in the vertical direction but prevents mutual tilting and mutual displacement in the horizontal directions. The center guide assembly 29 preferably comprise rollers, low-friction plates or equivalent elements located at the interface between the top segment 3 and the bottom segment 2.

Reference is now made to FIGS. 6-10, disclosing various embodiments of the container 1.

Figure 6:
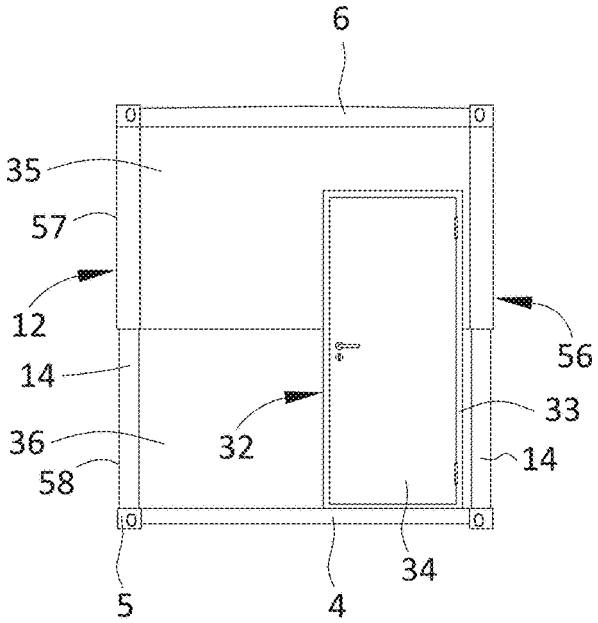
FIG. 6 is a schematic illustration disclosing one embodiment of an inner front-end panel of the telescopic shipping container in the erected configuration.
Figure 8:
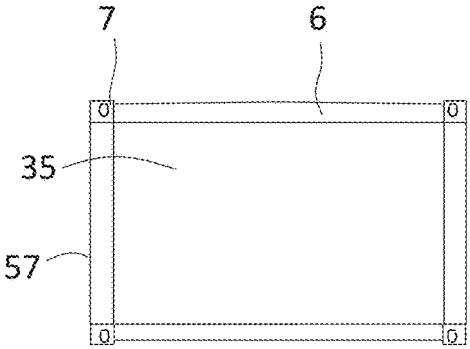
FIG. 8 is a schematic illustration disclosing the inner front-end panel according to FIG. 6, wherein the container is in the reduced configuration.

According to FIGS. 6 and 8, at least a part of at least the front-end panel 12 is constituted by an inner front-end panel having a door assembly 32. Reference is also made to FIG. 10, disclosing a cross section of the container 1 in the erected position and disclosing the door assembly 32 in a folded state, i.e. more or less horizontal, as well as in a standing state. The door assembly 32 is pivoted between the folded state and the standing state, and according to the disclosed embodiment the door assembly 32 is pivoted about a hinge arranged at the lower end of the door assembly 32. The door assembly 32 is preferably manually pivoted between the folded state and the standing state, e.g. by hand or by means of a pulley system. However, it is also conceivable that the container 1 comprises a suitable electrical motor in order to pivot the door assembly 32 or a mechanical linkage arrangement providing automatic pivot of the door assembly 32 when the top segment 3 is lowered and hoisted. The door assembly 32 comprises a door frame 33 and a door leaf 34, wherein the door leaf 34 is hinged to the door frame 33.

According to an alternative embodiment, the door assembly 32 is pivoted about a hinge arranged at the upper end of the door assembly 32, thereby the door assembly 32 may be pivoted from the standing state to the folded state, i.e. more or less horizontal, automatically or by means of a pulley system lifting the lower edge of the door assembly 32 before the top segment 3 is lowered.

After the door assembly 32 is pivoted from the folded state to the standing state, and vice versa, it is preferably secured/locked in place using sliding bolts or equivalent.

The inner front-end panel comprises a top section 35 rigidly connected to the roof panel 6 and comprises a bottom section 36 rigidly connected to the base panel 4. Thus, the door assembly 32 may extend all the way between the roof panel 6 and the base panel 4 and may be located adjacent one of the corner posts 56. According to the disclosed embodiment the top section 35 of the front-end panel 12 is rigidly connected to the roof panel 6 and to the top sections of the side panels 9, and according to the disclosed embodiment the bottom section 36 comprises a first part that is rigidly connected to the base panel 4 and to the bottom section of one of the side panels and a second part that is rigidly connected to the base panel 4 and to the bottom section of the other side panel. Thus, the inner front-end panel comprises an opening for the door assembly 32 that is distanced from both side panels and from the roof panel 6. Thus, the top section 35 of the inner front-end panel is part of the top segment 3 and the bottom section 36 of the inner front-end panel is part of the bottom segment 2. The top section 35 is located on the outside of the bottom section 36. When the door assembly 32 is in the standing state it is sealed to both the top section 35 of the front-end panel 12 and the bottom section 36 of the front-end panel 12.

According to various alternative embodiments the entire inner front-end panel is constituted by the door assembly 32, i.e. the door frame 33 occupies the entire area between the roof panel 6 and the base panel 4 and between the two side panels 9.

Figure 7:
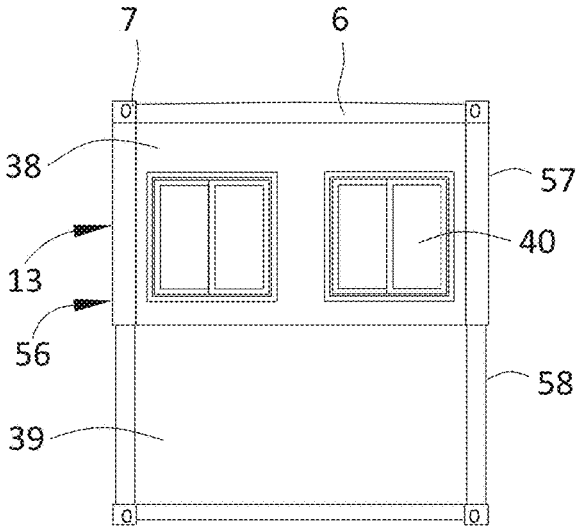
FIG. 7 is a schematic illustration disclosing one embodiment of a back-end panel of the telescopic shipping container in the erected configuration.
Figure 9:
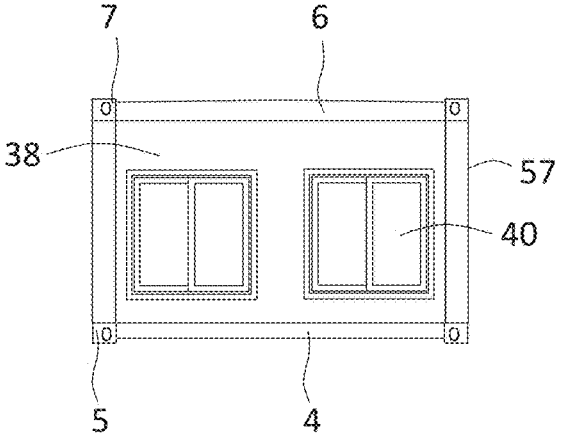
FIG. 9 is a schematic illustration disclosing the back-end panel according to FIG. 7, wherein the container is in the reduced configuration.
Figure 10A:
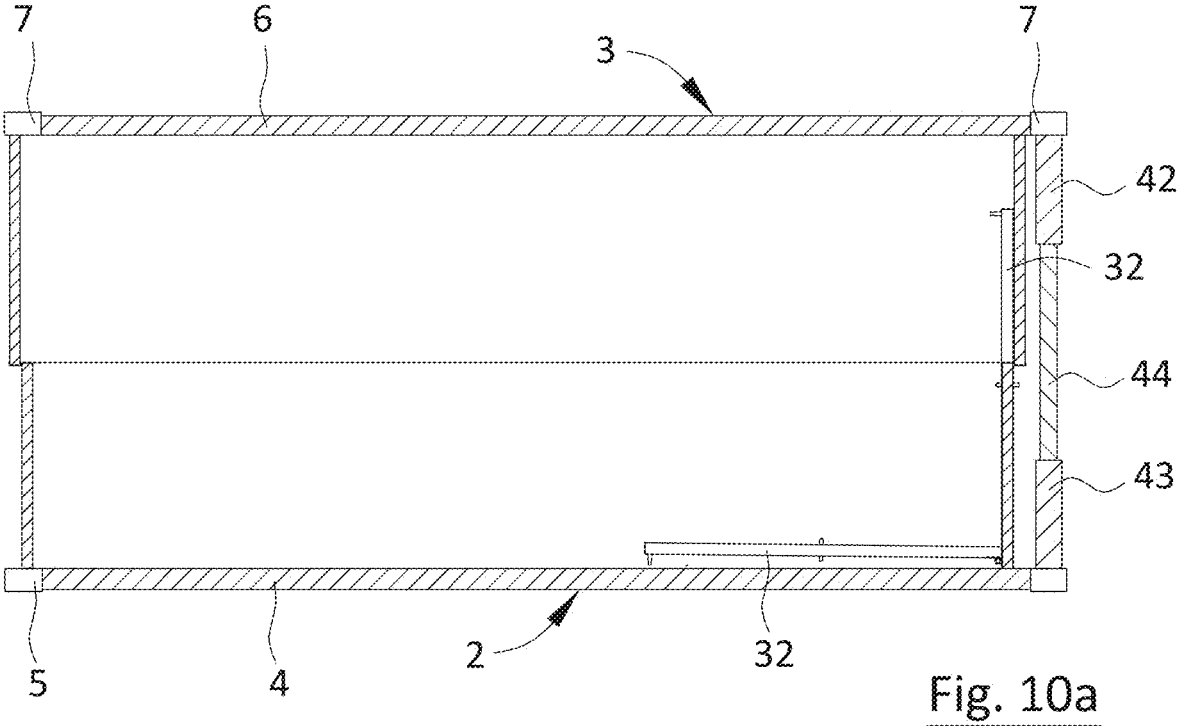
FIGS. 10*a-b* are schematic illustrations disclosing a cross sectional side view of the container according to FIGS. 6 and 8, wherein the container is in the erected configuration.
Figure 10B:
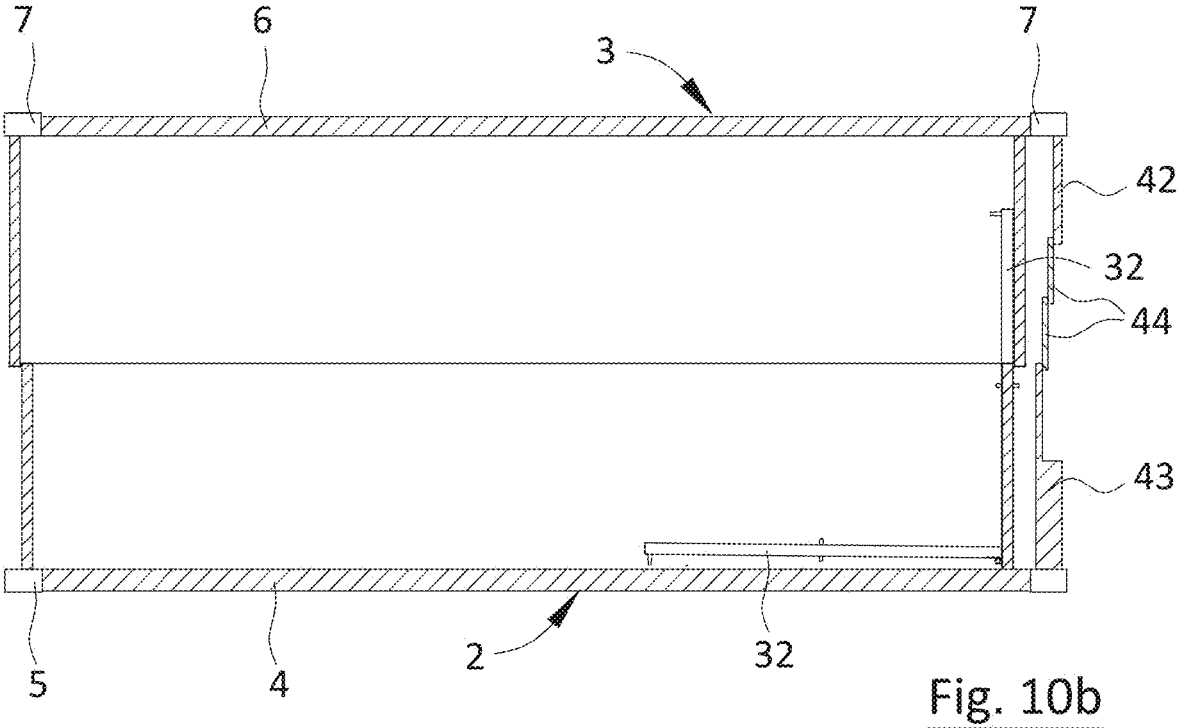

According to FIGS. 7 and 9 the back-end panel 13 comprises a top section 38 rigidly connected to the roof panel 6 and to the top elements 57 of the two adjoining corner posts 56 and having a bottom section 39 rigidly connected to the base panel 4 and to the bottom elements 58 of said two adjoining corner posts 56. Thus, the top section 38 of the back-end panel 13 is part of the top segment 3 and the bottom section 39 of the back-end panel 13 is part of the bottom segment 2. The top section 38 is located on the outside of the bottom section 39, in telescopic configuration. It shall be pointed out that the described/disclosed back-end panel 13 may constitute an inner back-end panel, mutatis mutandis in line with the above description of the inner front-end panel.

In the disclosed embodiment the top section 38 of the back-end panel 13 also comprises two windows 40, but it shall be pointed out that one or more of the wall panels may comprise one or more windows. It shall also be pointed out that a door assembly 32 may be located in one of the side panels or in the back-end panel, thus the above description of the inner front-end panel and door assembly 32 is then applicable to all wall panels.

According to various embodiments, at the interface between each pair of top section and bottom section of the wall panels, the container 1 comprises sealing means in order to prevent wind, moisture, dust, etc. from entering the container 1 when the container 1 is in the erected configuration. Preferably, the sealing means is also active when the container 1 is in the reduced configuration. Alternatively, a separate means may be arranged to seal between the base panel 4 and the lower ends of the top sections of the wall panels when the container 1 is in the reduced configuration.

Reference is now made to FIGS. 10*a*, 10*b*, 11 and 12, disclosing preferred embodiments of the front-end panel 12, which is also applicable to replace/supplement the back-end panel 13 disclosed above. When the container 1 comprises an inner front-end panel, the front-end panel 12 is located outside the inner front-end panel. Thus, the front-end panel 12 replace/supplement the inner front-end panel described/disclosed above. In such situations the front-end panel 12 is primarily intended to be used during transportation/storage.

The container 1 comprises a front-end panel 12 having at least one hinged door leaf 41, wherein the door leaf 41 comprises a top section 42 pivotably connected to the top element 57 of the adjacent corner post 56 and a bottom section 43 pivotably connected to the bottom element 58 of the adjacent corner post 56. According to the disclosed embodiment the front-end panel 12 comprises two such hinged door leaves 41, one door leaf 41 connected to each corner post 56. The two door leaves 41 engage each other when closed, such that the entire front-end panel is closed. According to various embodiments, the two door leaves 41 comprise interlocking means that engage each other when the door leaves 41 are closed, in order to provide stability to the front-end panel 12 and to the container 1.

The upper end of the top section 42 of the door leaf 41 engages the roof panel 6 when closed and follows the container top segment 3 during hoisting/lowering of the top segment 3. The lower end of the bottom section 43 of the door leaf 41 engages the base panel 4 when closed. Thus, during hoisting/lowering of the top segment 3 the top section 42 and the bottom section 43 of the door leaf 41 are displaced in the vertical direction in relation to each other.

Thereto the at least one door leaf 41 comprises an intermediate section 44 that is in telescopic engagement with the top section 42 and with the bottom section 43 of the door leaf 41, wherein the intermediate section 44 interconnects the top section 42 and the bottom section 43. Thus, outer part of the top section 42 and the outer part of the bottom section 42 does not overlap each other when the container 1 is in the reduced configuration, instead both are seen from the outside when the container is in the reduced configuration and when the container is in the erected configuration. When the container 1 is in the reduced configuration, the intermediate section 44 may be located on the inner side of the top section 42 and the bottom section 43, or may be located inside or in-between the top section 42 and the bottom section 43. The intermediate section 44 may comprise several sub-sections that are in telescopic engagement with each other. According to various embodiments, the bottom section 43 is furnished with an inner wall section that extends above the bottom section 43 and is in telescopic engagement with the top section 42 and/or the intermediate section 44. According to various embodiments, the top section 42 is furnished with an inner wall section that extends below the top section 42 and is in telescopic engagement with the bottom section 43 and/or the intermediate section 44. The entire door leaf is pivoted (opened/closed) as a single element both in the erected configuration and in the reduced/collapsed configuration. The intermediate section 44 is not pivotably connected directly to the corner post 56, but engage the corner post 56 when door leaf is closed.

According to various embodiments, each door leaf 41 comprises at least one locking bar assembly 45 having a telescopic locking bar 46. According to various embodiments each door leaf 41 comprises two locking bar assemblies 45. The locking bar assembly 45 is configured to engage the roof panel 6 and/or the base panel 4, when locked, both when the container is in the erected configuration and in the reduced configuration.

The locking bar 46 comprises an upper locking bar 47 that is rotationally journaled to the top section 42 of the door leaf 41 and comprises a cam 48 that is configured to engage a cam retainer 49 at the roof panel 6 upon rotation of the locking bar 46. The locking bar 46 comprises a lower locking bar 50 that is rotationally journaled to the bottom section 43 of the door leaf 41 and comprises a cam 51 that is configured to engage a cam retainer 52 at the base panel 4 upon rotation of the locking bar 46. The locking bar 46 comprises an intermediate locking bar 53, that is in telescopic engagement with the upper locking bar 47 and the lower locking bar 50. The lower locking bar 50 comprises a handle 54 in order to rotate the locking bar 46, in order to engage/disengage the cams and cam retainers. The handle 54 may be secured in a seat 55.

The upper locking bar 47 and the lower locking bar 50 preferably have circular outer cross section, and the intermediate locking bar 53 preferably has polygonal outer cross section. The inner cross section of the upper locking bar 47 and the lower locking bar 50 correspond/mate/engage the outer cross section of the intermediate locking bar 53 in order to transfer rotational movement, i.e. between the lower locking bar 50 and the upper locking bar 47 via the intermediate locking bar 53.

The door leaves 41 may be opened and closed at any time, i.e. when the container 1 is in the reduced configuration, in the erected configuration and therebetween.

Figure 11:
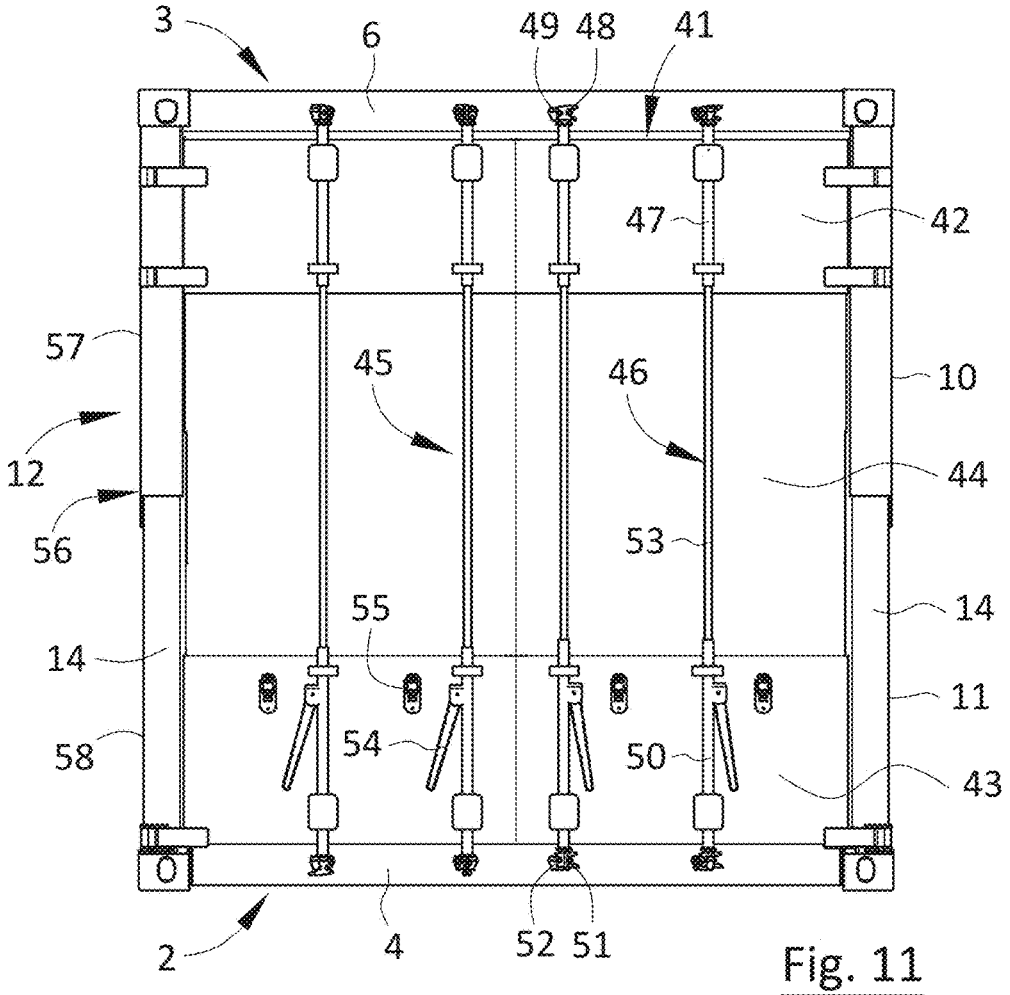
FIG. 11 is a schematic illustration disclosing one embodiment of a front-end panel of the telescopic shipping container in the erected configuration.
Figure 12:
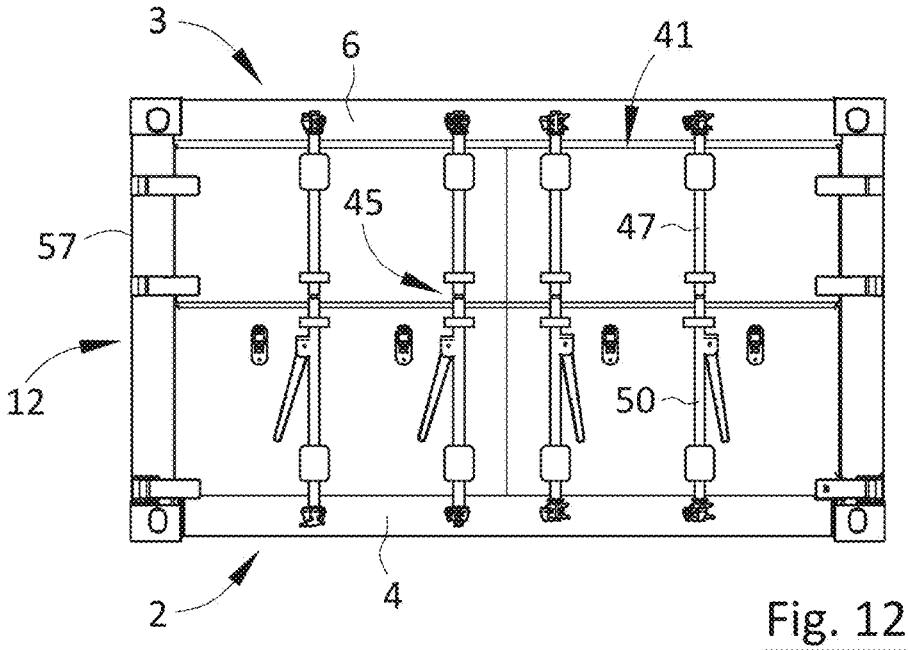
FIG. 12 is a schematic illustration disclosing the front-end panel according to FIG. 11, wherein the container is in the reduced configuration.

It shall be pointed out that the inner front-end panel disclosed in FIGS. 6, 8 and 10, and/or the back-end panel 13 disclosed in FIGS. 7 and 9, may be combined with the embodiment of the front-end panel disclosed in FIGS. 11 and 12, wherein the latter is arranged outside the former. Thereby the "cargo container door" solution disclosed in FIGS. 11 and 12 fulfil all regulations and the "inner" end panels are only used when the container is in the erected configuration and does not need to fulfil all regulations. During use of the container 1 the door leaves 41 of the front-end panel 12 may be secured in an open state along the outsides of the side panels 9.

The container 1 in the reduced configuration has a reduced height equal to half the height of a standard shipping container so that two containers 1 in the reduced configuration stacked one on top of the other occupy the same volumetric footprint as one standard shipping container. Thereto, the container 1 in the erected configuration has an erected height that is equal to or less than the height of a standard shipping container. According to various embodiments, the container 1 in the reduced configuration has a reduced height equal to the height of a standard shipping container and when erected the erected height is almost equal to the height of two standard shipping containers stacked on top of each other.

The container 1 may also comprise internal walls that comprise a top section rigidly connected to the roof panel 6 and a bottom section rigidly connected to at least the base panel 4, wherein the top section and the bottom section of the internal wall are in telescopic engagement with each other.

The use of the invention. The container 1 is transported/shipped by truck, rail, ship, plane, etc. in the reduced configuration, preferably comprising all equipment that is intended to be used in/at the container 1. When the container 1 reaches the final destination, the container top segment 3 is lifted/hoisted in order to transform the container 1 from the reduced configuration to the erected configuration. The lifting is made by means of the crane of the truck, using slings attached to the roof corner fittings 7 or to the base corner fittings 5 or using a spreader, or by means of a forklift engaging the roof panel 6 at the fittings 8. During the hoisting the girder assemblies 15 will move from the folded position to the upright position. When the top segment 3 reaches the erected configuration, the securing means 22 are activated/attached and thereby the container 1 is secured in the erected configuration. Thus, one operator may unload the container 1 and transform the container 1 from the reduces configuration to the erected (ready to be used) configuration within a few minutes. According to various embodiments, the container 1 may comprise hoisting/lowering means operated by hand or by a motor, such as a rack and pinion or a lift jack.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

The invention claimed is:

1. A telescopic shipping container transformable between a reduced configuration having reduced height and an erected configuration, the container comprising a top segment and a bottom segment, wherein the container bottom segment comprises a rigid base panel having four corner fittings and the container top segment comprises a rigid roof panel having four corner fittings, wherein the container comprises four corner posts each extending between one of the roof corner fitting and one of the base corner fitting and comprising a top element rigidly connected to the roof panel and a bottom element rigidly connected to the base panel, each corner post having a retractable/extendable configuration, wherein the container comprises a front-end panel having at least one hinged door leaf, wherein the door leaf comprises a top section pivotably connected to the top element of the adjacent corner post, a bottom section pivotably connected to the bottom element of said adjacent corner post, and an intermediate section that is in telescopic engagement with the top section of the door leaf and with the bottom section of the door leaf, wherein the intermediate section interconnects the top section and the bottom section.

2. The telescopic shipping container according to claim 1, wherein the door leaf comprises at least one locking bar assembly having a telescopic locking bar.

3. The telescopic shipping container according to claim 2, wherein the telescopic locking bar comprises an upper locking bar that is rotationally journaled to the top section of the door leaf, a lower locking bar that is rotationally journaled to the bottom section of the door leaf, and an intermediate locking bar that is in telescopic engagement with the upper locking bar and with the lower locking bar, wherein the intermediate locking bar interconnects the upper locking bar and the lower locking bar.

4. The telescopic shipping container according to claim 3, wherein the lower locking bar of the telescopic locking bar comprises a handle to rotate the locking bar.

5. The telescopic shipping container according to claim 3, wherein the upper locking bar and the lower locking bar have circular outer cross section, and the intermediate locking bar has polygonal outer cross section, wherein the inner cross section of the upper locking bar and the lower locking bar engage the outer cross section of the intermediate locking bar in order to transfer rotational movement.

6. The telescopic shipping container according to claim 1, wherein the container comprises at least four hinged girder assemblies, wherein each girder assembly comprises an upper end pivotably connected to the container top segment and a lower end pivotably connected to the container bottom segment, the girder assemblies being in upright position and supporting the container top segment when the container is in the erected configuration.

7. The telescopic shipping container according to claim 6, wherein the girder assemblies are secured in the upright position when the container is in the erected configuration, in order to prevent mutual displacement between the container top segment and the container bottom segment when the container is in the erected configuration.

8. The telescopic shipping container according to claim 6, wherein the girder assemblies are secured in a folded position when the container is in the reduced configuration, in order to prevent mutual displacement between the container top segment and the container bottom segment when the container is in the reduced configuration.

9. The telescopic shipping container according to claim 1, wherein the container comprises two side panels, each having a top section rigidly connected to the roof panel and constitutes part of the container top segment and a bottom section rigidly connected to the base panel and constitutes part of the container bottom segment.

10. The telescopic shipping container according to claim 9, wherein the top section and the bottom section of each side panel are in telescopic engagement with each other.

11. The telescopic shipping container according to claim 1, wherein the container comprises a back-end panel having a top section rigidly connected to the roof panel and constitutes part of the container top segment and a bottom section rigidly connected to the base panel and constitutes part of the container bottom segment.

12. The telescopic shipping container according to claim 11, wherein the top section and the bottom section of the back-end panel are in telescopic engagement with each other.

* * * * *